US008153053B2

(12) United States Patent
Nakai et al.

(10) Patent No.: US 8,153,053 B2
(45) Date of Patent: Apr. 10, 2012

(54) METHOD FOR FORMING COMPACT FROM POWDER AND SINTERED PRODUCT

(75) Inventors: Takashi Nakai, Niigata (JP); Kinya Kawase, Niigata (JP)

(73) Assignee: Diamet Corporation, Niigata-Shi (JP)

( * ) Notice: Subject to any disclaimer, the term of this patent is extended or adjusted under 35 U.S.C. 154(b) by 225 days.

(21) Appl. No.: 12/645,198

(22) Filed: Dec. 22, 2009

(65) Prior Publication Data

US 2010/0135841 A1 Jun. 3, 2010

Related U.S. Application Data

(63) Continuation-in-part of application No. 10/531,813, filed as application No. PCT/JP03/14643 on Nov. 18, 2003, now abandoned.

(30) Foreign Application Priority Data

Nov. 21, 2002 (JP) ..... 2002-338621

(51) Int. Cl.
*B22F 3/12* (2006.01)

(52) U.S. Cl. ..... 419/38; 419/66

(58) Field of Classification Search ..... 419/38, 419/66; 75/246

See application file for complete search history.

(56) References Cited

U.S. PATENT DOCUMENTS

| | | | | |
|---|---|---|---|---|
| 2,530,837 | A * | 11/1950 | Henricks et al. | 508/137 |
| 4,159,252 | A | 6/1979 | Wainwright et al. | |
| 4,707,309 | A | 11/1987 | Voss et al. | |
| 4,758,142 | A | 7/1988 | Thomae | |
| 4,765,917 | A | 8/1988 | Otaki et al. | |
| 5,518,639 | A | 5/1996 | Luk et al. | |
| 6,013,225 | A | 1/2000 | Cadle et al. | |
| 2001/0016174 | A1 | 8/2001 | Tsuchida et al. | |
| 2002/0034453 | A1 | 3/2002 | Kondo et al. | |
| 2003/0073587 | A1 | 4/2003 | Harrison et al. | |
| 2003/0130138 | A1 * | 7/2003 | Imai et al. | 508/154 |
| 2006/0022371 | A1 | 2/2006 | Nakai et al. | |

FOREIGN PATENT DOCUMENTS

| | | | |
|---|---|---|---|
| CA | 2363557 | | 6/2001 |
| CN | 1057478 | | 1/1992 |
| CN | 1171434 | | 1/1998 |
| CN | 1260825 | | 7/2000 |
| EP | 0 122 519 | A2 | 10/1984 |
| EP | 1170075 | | 1/2002 |
| EP | 1353341 | | 10/2003 |
| JP | 54-155912 | A | 12/1979 |
| JP | 59-205970 | A | 11/1984 |
| JP | 63-89592 | A | 4/1988 |
| JP | 6-158085 | A | 6/1994 |
| JP | 7-48589 | A | 2/1995 |
| JP | 7-26094 | U | 5/1995 |
| JP | 8-151592 | A | 6/1996 |
| JP | 9-272901 | A | 10/1997 |
| JP | 10-8085 | A | 1/1998 |
| JP | 2000-199002 | A | 7/2000 |
| JP | 2001-247891 | A | 9/2001 |
| JP | 3309970 | B2 | 7/2002 |
| JP | 2003-251499 | A | 9/2003 |
| JP | 2004167582 | A | 6/2004 |
| RU | 2152156 | | 7/2000 |
| WO | 97/48783 | A1 | 12/1997 |
| WO | PCT/JP00/08836 | | 6/2001 |

OTHER PUBLICATIONS

European Search Report mailed Feb. 8, 2010 for the corresponding European Patent Application No. 03772848.2.
Patent Abstracts of WO 01/43900 published Jun. 21, 2001.
International Search Report for PCT/JP03/14643 mailed on Mar. 2, 2004.
Patent Abstracts of Japan for 09-272901 published on Oct. 21, 1997.
Patent Abstracts of Japan for 54-155912 published on Dec. 12, 1979.
Patent Abstracts of Japan for 07-048589 published on Feb. 21, 1995.
Patent Abstracts of Japan for 2001-247891 published on Sep. 14, 2001.
Patent Abstracts of Japan for 06-158085 published on Jun. 7, 1994.
Patent Abstracts of Japan for 08-151592 published on Jun. 11, 1996.
Patent Abstracts of Japan for 10-008085 published on Jan. 13, 1998.
Translation of JP 07-26094 published on May 16, 1995.
Abstract of EP 0 122 519 published on Oct. 24, 1984.

* cited by examiner

*Primary Examiner* — Roy King
*Assistant Examiner* — Ngoclan T Mai
(74) *Attorney, Agent, or Firm* — Leason Ellis LLP.

(57) ABSTRACT

A method for forming a compact from a powder wherein a forming portion 1A in a mold body 2 is filled with a raw powder and upper and lower punches 3,4 are fitted into the forming portion 1A to form the compact. Prior to filling the forming portion 1A with the raw powder M, a solution L with a lubricant being uniformly dissolved in a solvent is applied to a peripheral portion of the forming portion 1A, and then the solution is evaporated, thus forming a crystallized layer B thereon. Thus, the reduction of a force for ejecting the compact is realized, while improving the density of the compact, realizing the stable and successive production of the compact.

6 Claims, 5 Drawing Sheets

METHOD FOR FORMING COMPACT FROM POWDER AND SINTERED PRODUCT

CROSS-REFERENCE TO RELATED APPLICATIONS

This application is a Continuation-in-Part of U.S. Non-Provisional application Ser. No. 10/531,813, filed on Apr. 18, 2005, which is the U.S. National Phase Application under 35 U.S.C. §371 of International Patent Application No. PCT/JP2003/014643 filed Nov. 18, 2003, which claims the benefit of Japanese Patent Application No. 2002-338621, filed on Nov. 21, 2002, all of which are incorporated by reference herein. The International Application was published in Japanese on Jun. 3, 2004 as WO/2004/045841 A1 under PCT Article 21(2).

FIELD OF THE INVENTION

The present invention relates to a method for forming a compact from a powder by filling raw powders in a mold for powder molding, and also relates to a mold apparatus for such powder molding.

DESCRIPTION OF THE RELATED ART

A green compact, which is used for the production of sintered products, is formed by pressing raw powders such as Fe-based powders, Cu-based powders or the like in a mold, and then a sintered body is formed through a sintering process. In the molding process, the compact undergoes a press-molding process, using a mold. At the time of the press-molding, however, a friction between a compact and a mold is generated. For this reason, when mixing raw powders, a water-insoluble fatty acid lubricant, such as zinc stearate, calcium stearate, lithium stearate, etc., is added so as to impart lubricity.

However, the method of mixing a lubricant in raw powders has limitations of improvement of the density of a compact. Accordingly, in order to obtain a high-density compact, there is proposed a method for forming a compact which can make up for the lack of lubricity by applying the same lubricant as the one added to raw powders to a mold while reducing the amount of lubricant added to raw powders.

This conventional method of molding is disclosed in, for example, Japanese Registered Patent Publication No. 3309970 (see paragraphs 0012 and 0013). This method comprises steps of: applying water dispersed in a high fatty acid lubricant to an inner surface of a heated mold by a spray gun so as to coat the inner surface therewith; and press-molding metal powders by filling the metal powders in the mold and pressing the same at such a pressure that the high fatty acid lubricant is chemically bonded to the metal powders so as to produce a film of metallic soap, wherein the mold is heated, and the inner surface thereof is coated with the high fatty acid lubricant such as lithium stearate; heated metal powders are filled into this mold and are subjected to press-molding at such pressure that the high fatty acid lubricant is chemically bonded to the metal powders so as to produce the film of metallic soap, whereby the film of metallic soap is produced on the inner surface of the mold to thereby reduce the friction between the compact of the metallic powders and the mold, thereby enabling the reduction of force for ejecting the compact.

As the fact that the same lubricant as one added to the raw powders is used for the mold results in the use of the water-insoluble lubricant, the lubricant applied to the metal is applied in a solid state. For this reason, other lubricant application methods are also known, such as electrostatic application of lubricant powders or dry application of lubricant which is dispersed in water by detergent and then dried. Further, there is also known a method for forming a compact using a water-soluble lubricant having a solubility of 3 g or more per 100 g water at 20 deg C., as disclosed in Japanese Un-examined patent application publication No. 2005-240167.

According to the conventional art disclosed in the above documents, however, since the lubricant dispersed in water is applied to the mold in a state of solid powders, that is, in such state that the solid powders of the lubricant are dispersed and mixed in water, a fine film can not be formed, and thus there is a problem that producing a compact of a stable quality is difficult. Further, according to the conventional art disclosed in the above publication No. 2005-240167, a large amount of water needs to be evaporated at a forming portion when a crystallized layer is formed.

The present invention has been made to solve the above problems. It is, accordingly, an object of the present invention to provide a method for forming a compact which enables the stable and accelerated production of a high density compact by forming a fine and uniform film of lubricant on a forming portion. Another object thereof is to provide a sintered product produced by such method.

SUMMARY OF THE INVENTION

In order to attain the above objects, a first aspect of the present invention proposes a method for forming a compact from a powder, comprising the steps of:

applying a solution obtained by dissolving a lubricant in a solvent to a forming portion of a mold body;

evaporating the solution to form a crystallized layer of the lubricant on a surface of the forming portion;

filling the forming portion of the mold body with a raw powder, said raw powder being Fe-based metal powder or Cu-based metal powder, and then fitting upper and lower punches into the forming portion, wherein said lubricant is at least one member selected from the group consisting of dipotassium hydrogen phosphate, disodium hydrogen phosphate, trisodium phosphate, sodium polyphosphate, riboflavin sodium phosphate, potassium sulfate, sodium sulfate, sodium thiosulfate, sodium dodecylsulfate, sodium dodecylbenzenesulfonate, Food Blue No. 1., Food Yellow No. 5., sodium ascorbyl sulfate, sodium tetraborate, sodium silicate, sodium tungstate, sodium acetate, sodium benzoate, sodium ascorbate, sodium hydrogen carbonate, sodium carbonate and potassium nitrate, and wherein said solution has said lubricant completely dissolved in water into a uniform phase in a concentration greater than or equal to one percent by weight, but less than a concentration of a saturated solution.

Further, a second aspect of the present invention proposes a method for forming a sintered product from a powder, comprising the steps of:

applying a solution obtained by dissolving a lubricant in a solvent to a forming portion of a mold body;

evaporating the solution to form a crystallized layer of the lubricant on a surface of the forming portion;

filling the forming portion of the mold body with a raw powder, said raw powder being Fe-based metal powder or Cu-based metal powder, fitting upper and lower punches into the forming portion;

pressing the raw powder to form a compact; and sintering the compact to form a sintered product, wherein said lubricant is at least one member selected from the group consisting of dipotassium hydrogen phosphate, disodium hydrogen phosphate, trisodium phosphate, sodium polyphosphate, riboflavin sodium phosphate, potassium sulfate, sodium sulfate, sodium thiosulfate, sodium dodecylsulfate, sodium dodecylbenzenesulfonate, Food Blue No. 1., Food Yellow No. 5., sodium ascorbyl sulfate, sodium tetraborate, sodium silicate, sodium tungstate, sodium acetate, sodium benzoate, sodium ascorbate, sodium hydrogen carbonate, sodium carbonate and potassium nitrate, and wherein said solution has said lubricant completely dissolved in water into a uniform phase in a concentration greater than or equal to one percent by weight, but less than a concentration of a saturated solution.

Further, a third aspect of the present invention proposes a method for forming a compact from a powder, comprising the steps of:

applying a solution obtained by dissolving a lubricant in a solvent to a forming portion of a mold body;

evaporating the solution to form only a crystallized layer of the lubricant on the forming portion;

filling the forming portion of the mold body with a raw powder, said raw powder being Fe-based metal powder or Cu-based metal powder, and then fitting punches into the forming portion, wherein said lubricant is at least one member selected from the group consisting of dipotassium hydrogen phosphate, disodium hydrogen phosphate, trisodium phosphate, sodium polyphosphate, riboflavin sodium phosphate, potassium sulfate, sodium sulfate, sodium thiosulfate, sodium dodecylsulfate, sodium dodecylbenzenesulfonate, Food Blue No. 1., Food Yellow No. 5., sodium ascorbyl sulfate, sodium tetraborate, sodium silicate, sodium tungstate, sodium acetate, sodium benzoate, sodium ascorbate, sodium hydrogen carbonate, sodium carbonate and potassium nitrate, wherein said lubricant has a solubility of 3 g or more per 100 g water at 20 deg C. in said solution, wherein said solution has said lubricant completely dissolved in water into a uniform phase in a concentration greater than or equal to one percent by weight, but less than a concentration of a saturated solution, and wherein the solution thus obtained is applied from a spray member to the forming portion in a spraying manner so as to cause the growth of crystal of said lubricant to thereby form said crystallized layer.

Further, a fourth aspect of the present invention proposes a sintered product produced by sintering a compact, said compact being obtained by pressure-forming a Fe-based or Cu-based metal raw powder in a forming portion in a mold, in which a solution obtained by dissolving a lubricant in a solvent is applied to the forming portion of a mold body, and then the solution is evaporated to form only a crystallized layer of the lubricant on the forming portion prior to filling the forming portion of the mold body with said metal raw powder, wherein said lubricant is at least one member selected from the group consisting of dipotassium hydrogen phosphate, disodium hydrogen phosphate, trisodium phosphate, sodium polyphosphate, riboflavin sodium phosphate, potassium sulfate, sodium sulfate, sodium thiosulfate, sodium dodecylsulfate, sodium dodecylbenzenesulfonate, Food Blue No. 1., Food Yellow No. 5., sodium ascorbyl sulfate, sodium tetraborate, sodium silicate, sodium tungstate, sodium acetate, sodium benzoate, sodium ascorbate, sodium hydrogen carbonate, sodium carbonate and potassium nitrate, wherein said lubricant has a solubility of 3 g or more per 100 g water at 20 deg C. in said solution, wherein said solution has said lubricant completely dissolved in water into a uniform phase in a concentration greater than or equal to one percent by weight, but less than a concentration of a saturated solution, and wherein the solution thus obtained is applied from a spray member to the forming portion in a spraying manner so as to cause the growth of crystal of said lubricant to thereby form said crystallized layer.

According to the foregoing first and second aspects of the present invention, a large amount of water is not evaporated at the forming portion, thus preventing the temperature drop at the forming portion and the waste of energy required for heating the forming portion, thereby leading to the accelerated forming speed.

According to the third and fourth aspects of the present invention, the lubricant is allowed to have a solubility of 3 g or more per 100 g water at 20 deg C. in the solution, and thus, even at the room temperature of about 20 deg C., a crystallized layer can be formed reliably.

BRIEF DESCRIPTION OF THE DRAWINGS

FIG. 1B is a partly enlarged cross-sectional view showing a part P of a mold according to the first embodiment;

DETAILED DESCRIPTION OF THE PREFERRED EMBODIMENT

Figure 1A:
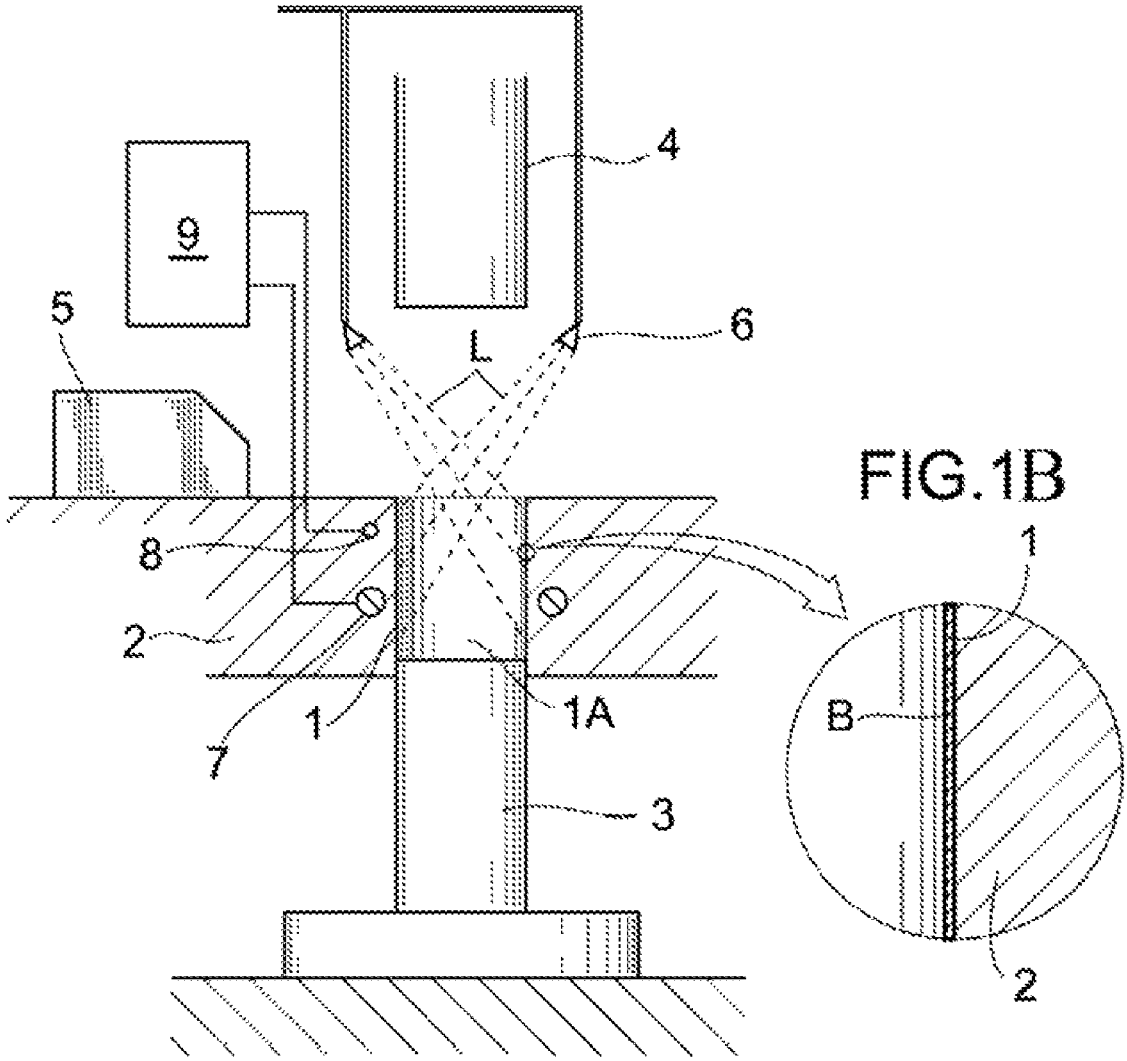
FIG. 1A is a schematic diagram showing a first process according to a first embodiment of the present invention.

A first embodiment of the present invention will now be explained with reference to the attached drawings. In FIG. 1A showing a first process, numeral 1 designates a through-hole formed in a die 2 serving as a mold for forming sides of a compact A as a later-described powder molded body. A lower punch 3 is fitted into the through-hole 1 from the underneath thereof and an upper punch 4 is also fitted into the through-hole 1 from the above thereof. A feeder 5, which provides a raw powder M, is slidably provided on an upper surface of the die 2. Above the through-hole 1 is provided a spray member 6 serving as a solution applying means for spraying a lubricant solution L so as to attach the same to a forming portion 1A of the mold. The spray member 6 is arranged so as to face the through-hole 1, and is connected to a tank of the solution L (not shown) via an automatically openable and closable valve (not shown). A heater 7 and a temperature detector 8 are provided around the periphery of the forming portion 1A for forming the compact A, the forming portion being defined by the through-hole 1 and the lower punch 3 engaged therewith. The heater 7 and the temperature detector 8 are connected to a temperature control device 9 serving as a temperature controlling means, which keeps temperature in the through-hole 1 higher than the evaporating temperature of the solution, and lower than the melting temperature of the lubricant.

In the first process, due to the heat of the heater 7 being pre-controlled by the temperature control system 9, the temperature of the periphery of the through-hole 1 is kept higher than the evaporating temperature of the solution L, and lower than the melting temperature of the lubricant beforehand. Then, the automatically openable and closable valve is opened to apply the solution L of the lubricant by spraying from the spray member 6 to the forming portion 1A of the die 2 heated by the heater 7, with the lower punch 3 being fitted into the through-hole 1 to define the forming portion 1A. As a result, the solution L is evaporated and dried out, and thus crystals are allowed to grow on the peripheral surface of the through-hole 1, so that a crystallized layer B of the lubricant is uniformly formed as shown in FIG. 1B.

Figure 2:
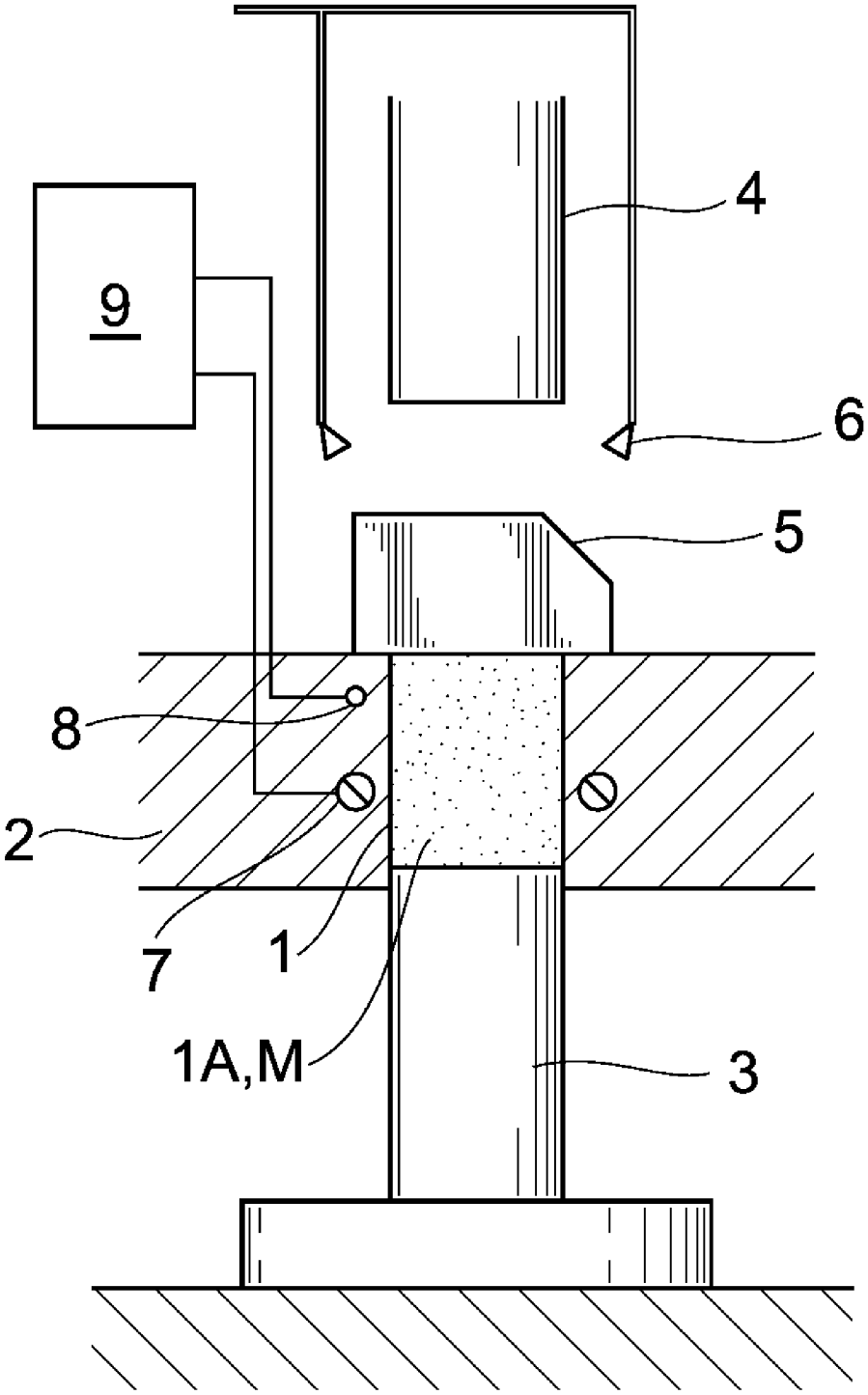
FIG. 2 is a schematic diagram showing a second process according to the first embodiment of the present invention.
Figure 3:
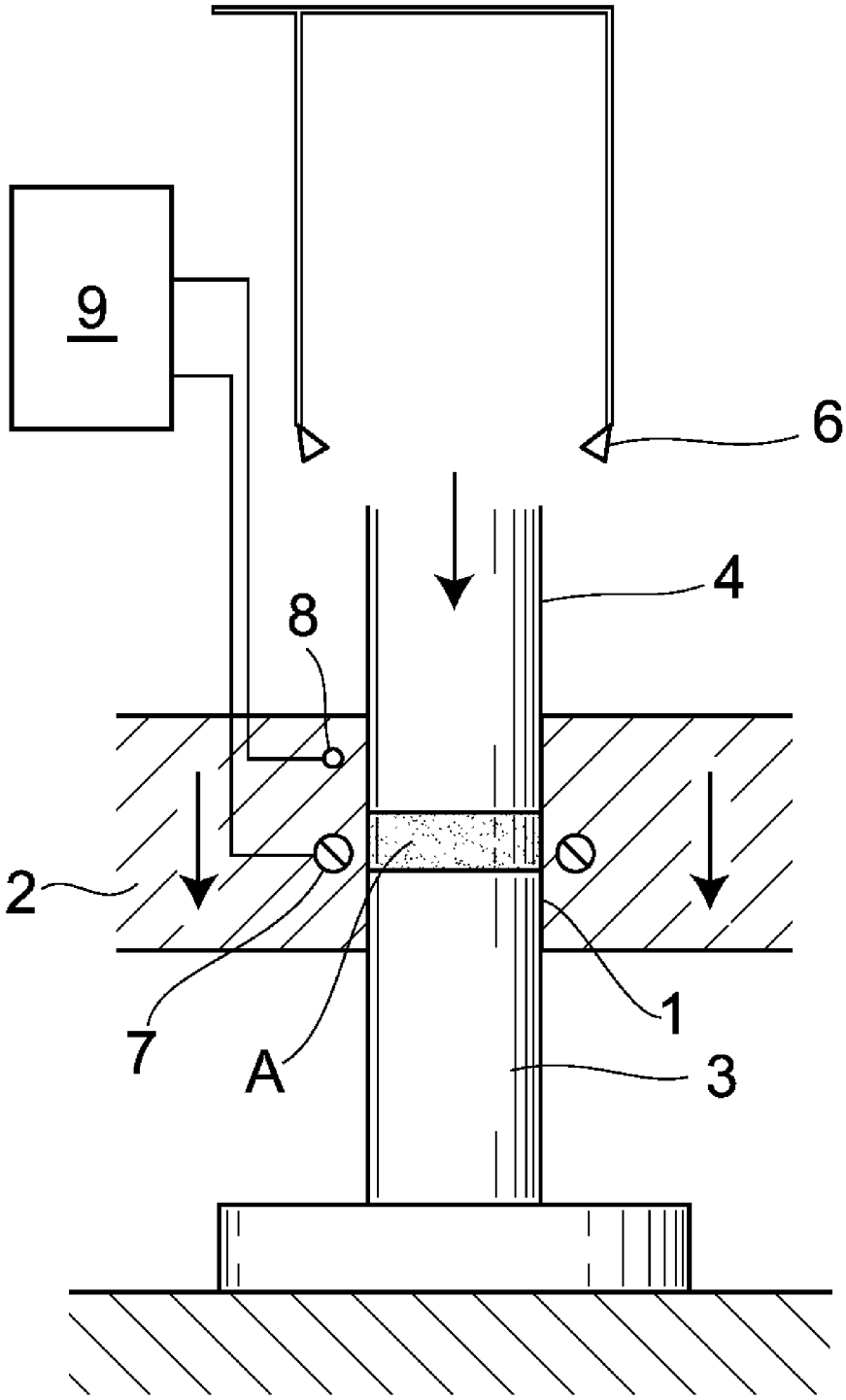
FIG. 3 is a schematic diagram showing a third process according to the first embodiment of the present invention.

Next, as illustrated in a second process shown in FIG. 2, the feeder 5 is moved forward so as to drop a raw powder M into the forming portion 1A to fill the same therewith. Subsequently, as illustrated in a third process shown in FIG. 3, the die 2 is moved downwardly, while the upper punch 4 is inserted into the forming portion 1A of the through-hole 1 from thereabove, so that the raw powder M is compressed in a manner that is sandwiched between the upper punch 4 and the lower punch 3. At this stage, a bottom end of the lower punch 3 is firmly held in position. In this third process, the material powder M is compressed by being pressed against the crystallized layer B formed of the lubricant with a lubrication property being imparted thereto by the layer B.

Figure 4:
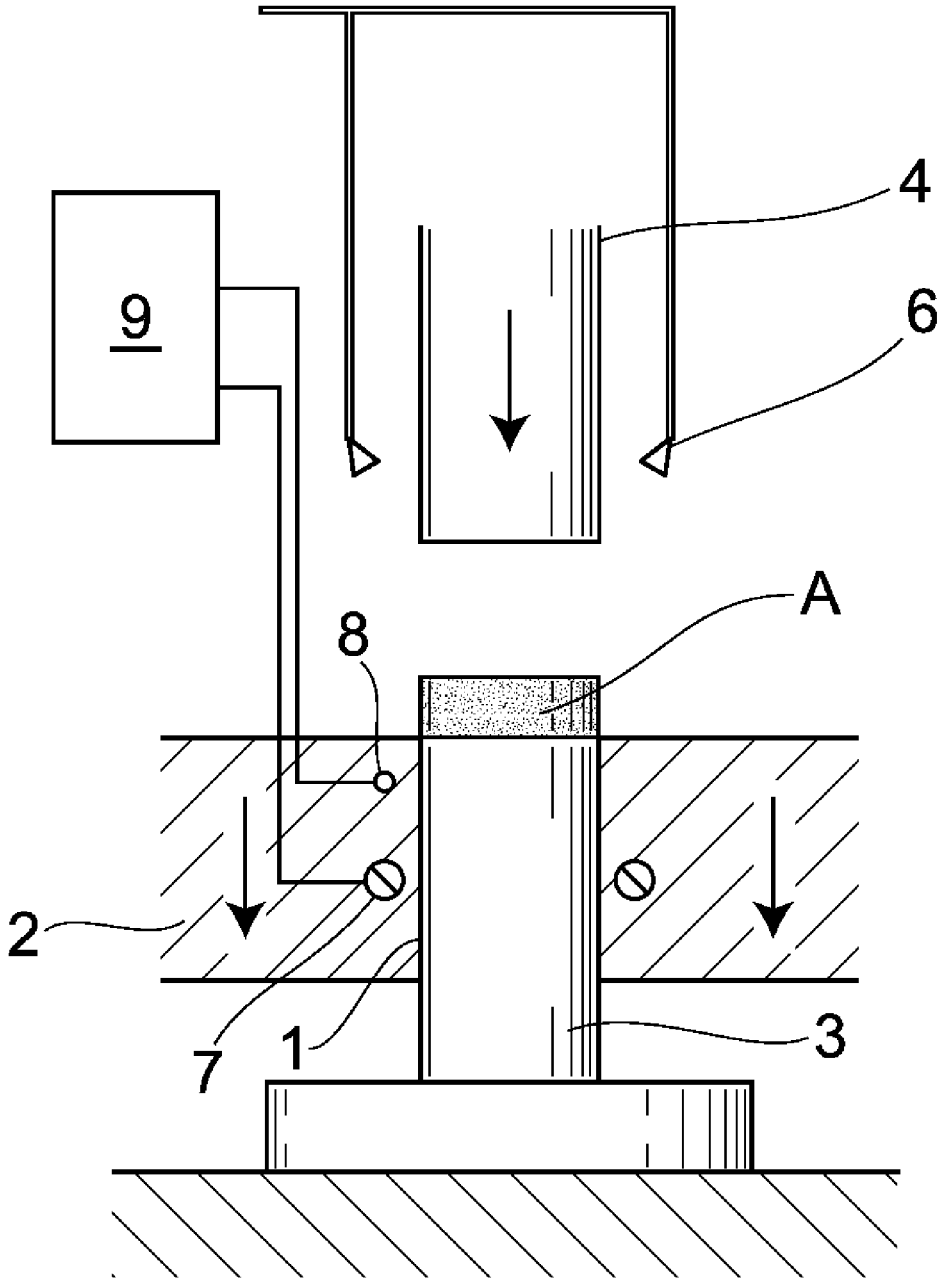
FIG. 4 is a schematic diagram showing a fourth process according to the first embodiment of the present invention.

The compact A thus press-molded becomes ejectable when the die 2 is moved further downwardly until the upper surface of the die 2 becomes essentially as high as the lower surface of the lower punch 3, as illustrated in a fourth process shown in FIG. 4. When ejecting the same, the compact A is allowed to contact the crystallized layer B that is formed of the lubricant and is in a lubricated condition, like in the third process. After ejecting the compact A thus way, the first process is repeated and thus the solution L is applied to the forming portion 1A again to form the crystallized layer B, and then the raw powder M is filled into the forming portion 1A.

Preferred examples and comparative examples will now be explained with reference to Tables 1 to 3. In each of the preferred examples and comparative examples shown in Tables 1 to 3, iron powders (average particle diameter: 90 μm) were used as the raw powder, to which was added 0.2% by weight of lithium stearate (average particle diameter: 5 μm) serving as the lubricant, which were then stirred for 30 minutes using a rotary mixer, so that 7 g of the resultant mixture of the raw powder was filled into a mold forming a cylindrical column having a 1 $cm^2$ pressurization area, and then 100 compacts were successively formed at a forming pressure of 8 $t/cm^2$. In the preferred examples, after the solution of the water-soluble lubricant dissolved in water was applied to the forming portion heated at 150 deg C. in the mold, it was evaporated and dried to form the crystallized layer, and then the raw powders were filled into this forming portion. In the comparative example 1, after the solution of lithium stearate (average particle diameter: 5 μm) dispersed in acetone was applied to the forming portion of the mold heated at 150 deg C., it was evaporated and dried to form a film, and then the material powders were filled into this forming portion. The comparative example 2 is a case in which the lubricant was not applied to the mold. Density R in each Table shows difference between maximum and minimum values in the density of 100 compacted bodies continuously molded.

TABLE 1

| | $1^{st}$ ex. | $2^{nd}$ ex. | $3^{rd}$ ex. | $4^{th}$ ex. | $5^{th}$ ex. |
|---|---|---|---|---|---|
| A | dipotassium hydrogen phosphate | disodium hydrogen phosphate | trisodium phosphate | sodium polyphosphate | Riboflavin sodium phosphate |
| B | water | Water | water | Water | Water |
| C | dissolved | dissolved | dissolved | dissolved | Dissolved |
| D | 1% | 1% | 1% | 1% | 1% |
| E | 150 deg C. | 150 deg C. | 150 deg C. | 150 deg C. | 150 deg C. |
| F | 6 kN | 8 kN | 6 kN | 8 kN | 20 kN |
| G | 7.56 $g/cm^3$ | 7.55 $g/cm^3$ | 7.56 $g/cm^3$ | 7.54 $g/cm^3$ | 7.50 $g/cm^3$ |
| H | 0.02 | 0.02 | 0.02 | 0.02 | 0.03 |

| | $6^{th}$ ex. | $7^{th}$ ex. | $8^{th}$ ex. | $9^{th}$ ex. |
|---|---|---|---|---|
| A | potassium sulfate | sodium sulfite | sodium thiosulfate | sodium dodecylsulfate |
| B | water | water | water | water |
| C | dissolved | dissolved | dissolved | dissolved |
| D | 1% | 1% | 1% | 1% |
| E | 150 deg C. | 150 deg C. | 150 deg C. | 150 deg C. |
| F | 18 kN | 20 kN | 18 kN | 16 kN |
| G | 7.52 $g/cm^3$ | 7.50 $g/cm^3$ | 7.51 $g/cm^3$ | 7.53 $g/cm^3$ |
| H | 0.02 | 0.02 | 0.02 | 0.03 |

A: Mold lubricating composition
B: Solvent
C: State of lubricating composition
D: Concentration
E: Forming temperature
F: Average ejecting force
G: Average compact density H:Density R

TABLE 2

| | $10^{th}$ ex. | $11^{th}$ ex. | $12^{th}$ ex. | $13^{th}$ ex. | $14^{th}$ ex. |
|---|---|---|---|---|---|
| A | sodium dodecylbenzene- | Food Blue | Food Yellow | sodium ascorbyl | sodium tetraborate |

TABLE 2-continued

| | | | | | |
|---|---|---|---|---|---|
| | sulfonate | No. 1 | No. 5 | sulfate | |
| B | water | water | water | Water | water |
| C | dissolved | dissolved | dissolved | dissolved | dissolved |
| D | 1% | 1% | 1% | 1% | 1% |
| E | 150 deg C. | 150 deg C. | 150 deg C. | 150 deg C. | 150 deg C. |
| F | 16 kN | 16 kN | 20 kN | 8 kN | 8 kN |
| G | 7.53 g/cm$^3$ | 7.53 g/cm$^3$ | 7.51 g/cm$^3$ | 7.54 g/cm$^3$ | 7.54 g/cm$^3$ |
| H | 0.02 | 0.03 | 0.04 | 0.02 | 0.02 |

| | 15th ex. | 16$^{th}$ ex. | 17$^{th}$ ex. | 18$^{th}$ ex. |
|---|---|---|---|---|
| A | sodium silicate | sodium tungstate | sodium acetate | sodium benzoate, |
| B | water | water | water | water |
| C | dissolved | dissolved | dissolved | dissolved |
| D | 1% | 1% | 1% | 1% |
| E | 150 deg C. | 150 deg C. | 150 deg C. | 150 deg C. |
| F | 10 kN | 12 kN | 18 kN | 10 kN |
| G | 7.54 g/cm$^3$ | 7.53 g/cm$^3$ | 7.51 g/cm$^3$ | 7.54 g/cm$^3$ |
| H | 0.03 | 0.03 | 0.02 | 0.02 |

TABLE 3

| | 19$^{th}$ ex. | 20$^{th}$ ex. | 21$^{st}$ ex. | 22$^{nd}$ ex. | 1$^{st}$ c. ex. | 2$^{nd}$ c. ex. | 3$^{rd}$ c. ex. |
|---|---|---|---|---|---|---|---|
| A | disodium terephthalate carbonate | sodium hydrogen | sodium carbonate | potassium nitrate | lithium stearate | none | sodium stearate |
| B | water | Water | water | water | acetone | | water |
| C | dissolved | dissolved | dissolved | dissolved | dispersed | | dissolved |
| D | 1% | 1% | 1% | 1% | 1% | | 0.2% |
| E | 150 deg C. | 150 deg C. | 150 deg C. | 150 deg C. | 150 deg C. | 150 deg C. | 150 deg C. |
| F | 1 kN | 18 kN | 18 kN | 20 kN | 22 kN | 32 kN | 16 kN |
| G | 7.54 g/cm$^3$ | 7.51 g/cm$^3$ | 7.52 g/cm$^3$ | 7.51 g/cm$^3$ | 7.50 g/cm$^3$ | 7.48 g/cm$^3$ | 7.52 g/cm$^3$ |
| H | 0.02 | 0.03 | 0.02 | 0.04 | 0.20 | 0.16 | 0.04 |

c. ex.: comparative example

Comparison result from Tables 1 to 3 indicates that the force required for ejecting a compact from a die in the examples were less than or equal to that of the comparative example 1. Besides, the densities were improved in the examples as compared to the comparative example 1. Moreover, the densities R in the examples noticeably became smaller than that of the comparative example 1. Therefore, it is apparent from the result that the high-density molding can be stably carried out according to the preferred examples, even though it is carried out successively.

As is clearly indicated in Tables 1 to 3, the aforesaid lubricant may preferably be a water-soluble phosphate based metal salt, or the one having a phosphate group in its structure, such as dipotassium hydrogen phosphate, disodium hydrogen phosphate, tripotassium phosphate, trisodium phosphate, potassium polyphosphate, sodium polyphosphate, riboflavin potassium phosphate, riboflavin sodium phosphate or the like.

As is also seen from Tables 1 to 3, it is preferable that, as a soluble sulfate-based salt, the lubricant may include a sulfate-based group in its structure, such as potassium sulfate, sodium sulfate, potassium sulfite, sodium sulfite, potassium thiosulfate, sodium thiosulfate, potassium dodecyl sulfate, sodium dodecyl sulfate, potassium dodecylbenzensulfonate, sodium dodecylbenzenesulfonate, Food Blue No. 1. (i.e., $C_{37}H_{34}N_2Na_2O_9S_3$), Food Yellow No. 5. (i.e., $C_{16}H_{10}N_2Na_2O_7S_2$), potassium ascorbyl sulfate, sodium ascorbyl sulfate.

As is also seen from Tables 1 to 3, it is preferable that, as a soluble borate-based metal salt, the lubricant may include a borate-based group in its structure, such as potassium tetraborate, sodium tetraborate.

Tables 1 to 3 also show that it is preferable that, as a soluble silicate-based metal salt, the lubricant may include a silicate-based group in its structure, such as potassium silicate, sodium silicate.

Still also, Tables 1 to 3 show that it is preferable that, as a soluble tungstate-based metal salt, the lubricant may include a tungstate-based group in its structure, such as potassium tungstate or sodium tungstate.

Table 1 to 3 show that it is preferable that, as a soluble organic-acid-based metal salt, the lubricant may include an organic-acid-based group in its structure, such as potassium acetate, sodium acetate, potassium benzoate, sodium benzoate, potassium ascorbate, sodium ascorbate.

It is also seen from Tables 1 to 3, that it is preferable that, as a soluble nitrate-based metal salt, the lubricant may include a nitrate-based group in its structure such as potassium nitrate, sodium nitrate.

It is still also seen from Tables 1 to 3 that it is preferable that, as a soluble carbonate-based metal salt, the lubricant may include a carbonate-based group in its structure, such as potassium carbonate, sodium carbonate, potassium hydrogen carbonate or sodium hydrogen carbonate.

Alternatively, one or more of the foregoing lubricants may be used as the lubricant.

The water-soluble lubricant should have a concentration greater than or equal to one percent by weight, but less than a concentration of a saturated solution. This is because the concentration of less than 1 w % makes it necessary to evaporate a large amount of water at the forming portion, resulting in some problems such as decrease of productivity caused by the decreased forming speed due to the temperature drop at the forming portion and waste of energy required for heating the forming portion, as well as mold breakage caused by the implementation of forming prior to a crystallized layer being formed after water is evaporated, while the lubricant solution having the saturated concentration or above does not allow the lubricant to be completely dissolved so that it is precipitated as a solid, thus casing troubles such as the clogging of the spray pump 6 when applying lubricant using the same.

For example, in the case of common metal salts of higher fatty acid such as sodium stearate and potassium stearate, the temperature of the water solution needs to be raised up to a high temperature in order to obtain the solution of 1 w % or more concentration. Besides, if metal components such as magnesium or calcium are contained in water used then, there are produced precipitates of magnesium stearate or calcium stearate, etc., causing troubles such as clogging of the spray nozzle, non-uniform crystallized layer, etc, and thus it is not appropriate.

As for concentration, the higher the concentration is, the less the amount of the lubricant solution required for obtaining a crystallized layer becomes, resulting in the improvement of productivity due to increased forming speed and decreased energy loss, etc.

Further, some lubricants, though also depending on a kind thereof, facilitate the growing of microorganisms and thus the solution is easily decayed, thereby causing a change in components, emitting bad smell. However, adding an antiseptic agent can prevent the growing of microorganisms. For the antiseptic agent, it is preferable to use one which does not impair lubrication property, produces low harmful effects to a human body, and includes no halogen components, such as sodium benzoate or the like.

Furthermore, some lubricants have a problem that foaming easily occurs, and thus when the solution (L) is applied to the forming portion (1A), such forming is likely to occur so that a raw powder is caked. However, by adding a water-soluble solvent such as alcohol or ketone, or a defoaming agent, such foaming can be prevented. For alcohol or ketone, it is preferable to use one which does not impair the lubricating action, causes less damages to a human body, and does not include halogen components, such as ethanol, acetone or the like.

In some cases, using a water-soluble solvent such as alcohol and ketone with a lower boiling point or a lower latent heat of evaporation than water can reduce hours for evaporation or dry, eliminating the need for keeping the mold body 2 at high temperature.

In a case where these lubricants, additives or dissolvent water include halogen elements, a substance that is highly toxic even in minute amounts such as dioxin is likely to be created under such a condition that sintering is performed with carbon components being coexistent, as is often used in powder metallurgy of iron. Therefore it is preferable to include no halogen elements therein.

As for the temperature of the mold body 2 and the mixed raw powder M, keeping them at high temperature is desirable because it contributes to reduction of hours for drying, accompanied by effects of warm forming and the like. If there is caused no particular trouble, however, it can be kept at ordinary temperature. On the other hand, when setting them at high temperature, it is preferable to choose such a lubricant that is not melt down at a preset temperature, since the melt lubricant makes it difficult to stably perform warm compaction due to the melt lubricant caking a raw powder, flowing down to the bottom of the die (the forming portion 1A). If there is caused no particular trouble, however, it may be in a semi-molten state, in a highly viscous state, or otherwise, at least one lubricant of the mixed two or more lubricants may be in a molten state. Since zinc stearate and lithium stearate that have been conventionally used have melting temperatures of about 120 deg C. and about 220 deg C., respectively, it has heretofore been difficult to stably perform warm compaction at a temperature higher than these temperatures. Among the lubricants proposed in the present invention, however, there are a number of lubricants that have a higher melting point than 220 deg C., and some of them have a higher melting point than 1000 deg C. Therefore it is possible to easily and stably perform warm compaction by raising the temperature up to an upper temperature limit of the die (the forming portion 1A) or almost to an oxidization temperature of the raw powder. In that case, however, there occur problems such as fluidity of the raw powder, and thus it is preferable to use the lubricant that does not melt even under high temperature, as the one to be added into the mixed raw powder M. For example, the powdery lubricants of the present invention or solid lubricants such as graphite or molybdenum disulfide are preferable. Alternatively, it is also preferable to form the compact only by lubrication of the mold body itself without using the lubricant.

Figure 5:
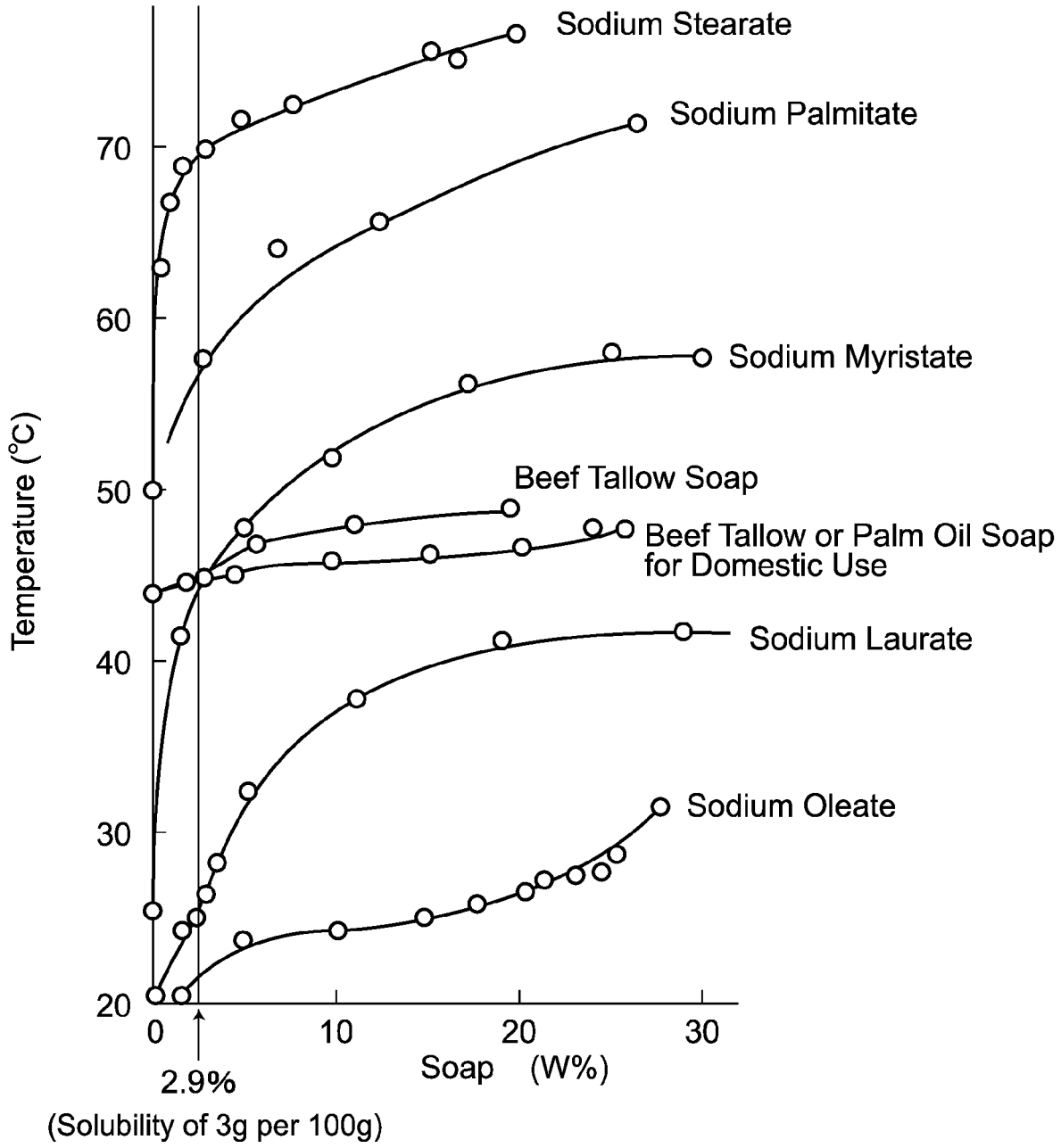
FIG. 5 is a graph showing a solubility of soaps.

Next is a description of the water-solubility feature of the present invention, proposing solubility of 3 g or more per 100 g water at 20 deg C. As shown in solubility graph of various kinds of fatty acid soaps in FIG. 5, any of the blend soaps made from ordinary animal oil or vegetable oil and their main components has an extremely low solubility relative to water at room temperature, and are liable to produce precipitates in a short time after they are dissolved in water. Specifically, at or around 20 deg C. at which they are normally used under room temperature, there are produced precipitates, causing troubles such as the clogging of the spray member. Accordingly, the inventors' recognition that the solubility that does not allow these components to be contained is imperative at minimum requirement has led to the proposed solubility of 3 g or more per 100 g water at 20 deg C. For this reason, sodium stearate and potassium stearate are to be excluded.

According to the description of the foregoing embodiment, there is provided a method for forming a compact from a powder, including the steps of filling the forming portion 1A in the mold body 2 with the raw powder M; and then inserting upper and lower punches 3, 4 into the forming portion 1A to thereby form the compact, wherein prior to filling the forming portion 1A with the raw powder M, the solution L with a lubricant dissolved in a solvent to a uniform phase is applied to the forming portion 1A, and then the solution L is evaporated to thereby form the crystallized layer B on the forming portion 1A. Thus, the fine crystallized layer B for lubrication is formed on the peripheral surface of the forming portion 1A, thereby achieving the reducing of a force required for ejecting the compact A from the forming portion 1A as well as the improving of the density thereof.

Further, as the concentration of the water-soluble lubricant of the present invention is one percent by weight or more, a large amount of water is not evaporated at the forming portion 1A, preventing the temperature drop at the forming portion 1A and the waste of energy required for heating the forming portion 1A, thus leading to the accelerated forming speed, enabling the improvement of productivity. Further, by using the lubricant having the solubility of 3 g or more per 100 g water at 20 deg C., no precipitates are produced in the solution L around 20 deg C. at room temperature at which the lubricant is ordinarily used, enabling the spray operation to be performed smoothly without causing the clogging of the spray member 6, ensuring the uniform concentration of the solution to be sprayed to the forming portion.

Also, according to the foregoing embodiment, there is provided a mold apparatus for powder molding, comprising: the mold body 2 with the through-hole 1 for forming a side of the compact A; the lower punch 3 to be fitted into the through-hole 1 from beneath; the upper punch 4 to be fitted into the through-hole 1 from above; the spray pump 6 from which the lubricant solution L is sprayed to the through-hole 1; the heater 7 provided around the forming portion 1A of the mold body 2, the forming portion 1A being defined by the through-hole 1 and the lower punch 3; and the temperature control system 9 keeping a temperature of the heater 7 higher than an evaporating temperature of the solution L, but lower than a melting temperature of the lubricant.

Thus, the solution L of the lubricant is applied to the pre-heated forming portion 1A prior to the raw powder M being filled in the forming portion 1A, so that the solution L is evaporated to thereby form the fine crystallized layer B on the peripheral surface of the forming portion 1A. Accordingly, the fine crystallized layer B is reliably formed on the peripheral surface of the forming portion 1A, thus enabling the reduction of a force for ejecting the compact A from the forming portion 1A as well as the improvement of the density of the compact A, realizing the stable and successive production of the compact A.

The present invention is not limited to the forgoing embodiment but may be modified within the scope of the invention. The solution in which the lubricant is dissolved in the solvent in the foregoing embodiment may be the one in which a part of the lubricant is dissolved in the solvent, can be used. Although in the foregoing embodiment, the solution is applied to the forming portion and then evaporated to form the crystallized layer on the forming portion prior to filling the raw powder, and then the punches fitted into the forming portion to thereby form the compact powder, it is not always necessary to form the crystallized layer on the forming portion by applying the solution thereto and then evaporating the same, prior to filling the raw powder. For example, after forming a first compact, a second compact may be formed by filling a second raw powder, utilizing the crystallized layer formed when the first compact is formed, without applying the solution to the forming portion, and then the solution may be applied to the forming portion prior to filling a third raw powder, and then it is evaporated, to thereby form a second crystallized layer on the forming portion. The solution may be applied to the forming portion in such an intermittent manner.

What is claimed is:

1. A method for forming a compact from a powder, comprising the steps of:

applying a solution obtained by dissolving a lubricant in a solvent to a forming portion of a mold body;

evaporating the solution to form a crystallized layer of the lubricant on a surface of the forming portion;

filling the forming portion of the mold body with a raw powder, said raw powder being Fe-based metal powder or Cu-based metal powder; and then fitting upper and lower punches into the forming portion, wherein said lubricant is at least one member selected from the group consisting of dipotassium hydrogen phosphate, disodium hydrogen phosphate, trisodium phosphate, sodium polyphosphate, riboflavin sodium phosphate, potassium sulfate, sodium sulfate, sodium thio sulfate, sodium dodecylsulfate, sodium dodecylbenzenesulfonate, Food Blue No. 1., Food Yellow No. 5., sodium ascorbyl sulfate, sodium tetraborate, sodium silicate, sodium tungstate, sodium acetate, sodium benzoate, sodium ascorbate, sodium hydrogen carbonate, sodium carbonate and potassium nitrate, and wherein said solution has said lubricant completely dissolved in water into a uniform phase in a concentration greater than or equal to one percent by weight, but less than a concentration of a saturated solution.

2. The method for forming a compact from a powder set forth in claim 1, wherein an antiseptic substance is added into the lubricant.

3. The method for forming a compact from a powder set froth in claim 1, wherein a defoaming agent is added into the lubricant.

4. A method for forming a sintered product from a powder, comprising the steps of:

applying a solution obtained by dissolving a lubricant in a solvent to a forming portion of a mold body;

evaporating the solution to form a crystallized layer of the lubricant on a surface of the forming portion;

filling the forming portion of the mold body with a raw powder, said raw powder being Fe-based metal powder or Cu-based metal powder;

fitting upper and lower punches into the forming portion;

pressing the raw powder to form a compact; and sintering the compact to form a sintered product, wherein said lubricant is at least one member selected from the group consisting of dipotassium hydrogen phosphate, disodium hydrogen phosphate, trisodium phosphate, sodium polyphosphate, riboflavin sodium phosphate, potassium sulfate, sodium sulfate, sodium thiosulfate, sodium dodecylsulfate, sodium dodecylbenzenesulfonate, Food Blue No. 1., Food Yellow No. 5., sodium ascorbyl sulfate, sodium tetraborate, sodium silicate, sodium tungstate, sodium acetate, sodium benzoate, sodium ascorbate, sodium hydrogen carbonate, sodium carbonate and potassium nitrate, and wherein said solution has said lubricant completely dissolved in water into a uniform phase in a concentration greater than or equal to one percent by weight, but less than a concentration of a saturated solution.

5. The method for forming a compact from a powder as set forth in claim 1, wherein the step of applying a solution is carried out by spraying the solution.

6. A method for forming a compact from a powder, comprising the steps of:

applying a solution obtained by dissolving a lubricant in a solvent to a forming portion of a mold body;

evaporating the solution to form only a crystallized layer of the lubricant on the forming portion;

filling the forming portion of the mold body with a raw powder, said raw powder being Fe-based metal powder or Cu-based metal powder; and then fitting punches into the forming portion, wherein said lubricant is at least one member selected from the group consisting of dipotassium hydrogen phosphate, disodium hydrogen phosphate, trisodium phosphate, sodium polyphosphate, riboflavin sodium phosphate, potassium sulfate, sodium sulfate, sodium thiosulfate, sodium dodecylsulfate, sodium dodecylbenzenesulfonate, Food Blue No. 1., Food Yellow No. 5., sodium ascorbyl sulfate, sodium tetraborate, sodium silicate, sodium tungstate, sodium acetate, sodium benzoate, sodium ascorbate, sodium hydrogen carbonate, sodium carbonate and potassium nitrate, wherein said lubricant has a solubility of 3 g or more per 100 g water at 20 deg C. in said solution, wherein said solution has said lubricant completely dissolved in water into a uniform phase in a concentration greater than or equal to one percent by weight, but less than a concentration of a saturated solution, and wherein the solution thus obtained is applied from a spray member to the forming portion in a spraying manner so as to cause the growth of crystal of said lubricant to thereby form said crystallized layer.

* * * * *